US007561403B2

(12) United States Patent
Onezawa et al.

(10) Patent No.: US 7,561,403 B2
(45) Date of Patent: Jul. 14, 2009

(54) STATIC ELIMINATOR AND ELECTRIC DISCHARGE MODULE

(75) Inventors: Kazuyoshi Onezawa, Tokyo (JP); Yoshinari Fukada, Tokyo (JP); Yosuke Enomoto, Tokyo (JP)

(73) Assignees: Koganei Corporation, Tokyo (JP); Shishido Electrostatic, Ltd., Tokyo (JP)

( * ) Notice: Subject to any disclaimer, the term of this patent is extended or adjusted under 35 U.S.C. 154(b) by 214 days.

(21) Appl. No.: 11/332,411

(22) Filed: Jan. 13, 2006

(65) Prior Publication Data

US 2006/0187597 A1 Aug. 24, 2006

(30) Foreign Application Priority Data

Jan. 17, 2005 (JP) ..... 2005-008567

(51) Int. Cl.
*H01T 23/00* (2006.01)

(52) U.S. Cl. ..... 361/231; 361/230; 361/233

(58) Field of Classification Search ..... 361/231
See application file for complete search history.

(56) References Cited

U.S. PATENT DOCUMENTS

| | | | | |
|---|---|---|---|---|
| 3,104,831 | A * | 9/1963 | Scowen | 362/369 |
| 3,582,711 | A * | 6/1971 | Jahnke | 361/231 |
| 4,253,852 | A * | 3/1981 | Adams | 96/58 |
| 4,872,852 | A * | 10/1989 | Palitz, Jr. | 439/307 |
| 5,407,270 | A * | 4/1995 | Barile et al. | 366/247 |
| 5,876,220 | A * | 3/1999 | Yeh | 439/79 |
| 6,717,792 | B2 * | 4/2004 | Gorczyca et al. | 361/212 |
| 6,757,150 | B2 * | 6/2004 | Gorczyca et al. | 361/231 |
| 7,054,130 | B2 * | 5/2006 | Gorczyca et al. | 361/231 |
| 7,126,807 | B2 * | 10/2006 | Mizuno et al. | 361/213 |
| 7,375,945 | B2 * | 5/2008 | Izumi et al. | 361/231 |
| 2002/0069611 | A1 * | 6/2002 | Leopolder | 52/748.1 |
| 2002/0141131 | A1 * | 10/2002 | Gorczyca et al. | 361/231 |
| 2005/0270722 | A1 * | 12/2005 | Gorczyca et al. | 361/230 |

FOREIGN PATENT DOCUMENTS

| | | |
|---|---|---|
| CN | 1357952 A | 7/2002 |
| JP | 2004-234972 | 8/2004 |
| JP | 2004-253192 | 9/2004 |

OTHER PUBLICATIONS

Chinese Office Action dated Apr. 17, 2009 corresponding to the pending Chinese application along with English translation.

* cited by examiner

*Primary Examiner*—Fritz M Fleming
*Assistant Examiner*—Tien Mai
(74) *Attorney, Agent, or Firm*—McCormick, Paulding & Huber LLP

(57) ABSTRACT

A static eliminator capable of replacing a discharge needle and improving maintainability of the eliminator is disclosed. The static eliminator comprises: an air-guiding duct having a tubular portion provided with an outer electrode and a boss portion; and an electric discharge module detachably mounted on the tubular portion, wherein ionized air is supplied to the air-guiding duct by a fan of an air blower. The electric discharge module has a holder fitted in a boss portion and a plurality of discharge electrodes attached to the holder so as to protrude toward the outer electrode in an outer-radial direction. When foreign substances or the like adhere to a tip of the discharge electrode or when the discharge electrode deteriorates, the electric discharge module is detached from the boss portion.

9 Claims, 6 Drawing Sheets

STATIC ELIMINATOR AND ELECTRIC DISCHARGE MODULE

CROSS-REFERENCED TO RELATED APPLICATIONS

Applicant hereby claims foreign priority benefits under U.S.C. § 119 from Japanese Patent Application No. 2005-8567 filed on Jan. 17, 2005, the contents of which are incorporated by reference herein.

BACKGROUND OF THE INVENTION

The present invention relates to a static eliminator and an electric discharge module for eliminating static electricity from an object to be processed such as an electronic component charged with static electricity.

In the case of manufacturing and assembling the electronic components, if static electricity is charged in jigs etc. for manufacturing and assembling the electronic components, foreign substances such as dust adhere to the electronic components etc. and defective goods are produced, whereby the electronic components during a transfer process are mutually attracted and contact with each other and cannot be transferred smoothly. Therefore, a static eliminator also called an ionizer or ion generator is used to blow ionized air onto the object to be processed such as a portion or component charged with static electricity. In order to ionize air through electric energy, a high voltage is applied to a needle-shaped discharge electrode to generate a non-uniform electric field around the discharge electrodes, whereby a corona discharge is caused in the non-uniform electric field and the surrounding air is ionized by the corona discharge. When a high plus voltage is applied to the discharge electrode, the discharge electrodes absorb electrons from air near the electrodes and the air becomes positive ions. When a high minus voltage is applied, the discharge electrodes discharge electrons and then the air becomes negative ions.

When a high alternating-current voltage is applied to the discharge electrode, positive and negative air ions are generated basically to the same amount. When such ionized air is blown onto an electrified object to be processed (hereinafter abbreviated as "object"), the object repels the same polarity ions and attracts opposite polarity ions thereto. For this reason, when the opposite polarity ions contact with the object, an electric charge level of the object decrease gradually. Consequently, the object becomes in an equilibrium state at a low potential and is neutralized.

Such a static eliminator includes one as disclosed in Japanese Patent Laid-Open Publication No. 2004-253192, i.e., one called a fan type in which air blown by a fan onto the object is ionized by the discharge electrode.

When air is ionized by the corona discharge, insulating materials such as foreign substances educed out from the air adhere to a tip of the discharge electrode and are therefore required to be removed regularly. Furthermore, when the tip of the discharge electrode is worn down or deteriorates, replacement of the discharge electrode is necessary. For this reason, the static eliminator disclosed in the above gazette is constituted by: a frame-shaped detachable unit in which a circular hole, to which a plurality of discharge electrodes are attached opposite to one another, is formed and to which a high-voltage power-supply unit is attached; and a main body case in which a fan is incorporated and to which the detachable unit is attached. Thereby, when any discharge electrode is worn down, the detachable unit is replaced. The discharge electrodes are attached to the detachable unit so as to mutually oppose, toward a center portion of the circular hole, an inner circumferential face of the circular hole in which air flows. Therefore, an inner diameter of the circular hole must be enlarged to ensure sufficiently a ionized air flow rate and enlargement of the detachable unit is required accordingly. Since the detachable unit is made large, the high-voltage power-supply unit can be mounted on the detachable unit.

SUMMARY OF THE INVENTION

However, in order to replace the worn discharge electrode by a new discharge electrodes, replacement of the enlarged detachable unit to which the high-voltage power supply unit is attached is required, and the detachable unit which includes the high-voltage power-supply unit is discarded and the usable high-voltage power-supply unit is also discarded. Therefore, maintenance cost of the static eliminator for ensuring a normal generation of ions becomes high. Additionally, since a removing/attaching direction of the detachable unit from/to the main body case is perpendicular to an air flow, a space for drawing the detachable unit is required to be ensured in a portion for detaching the detachable unit. Therefore, a mounting place for the static eliminator is restricted and simultaneously its maintenance operation cannot be carried out easily.

An object of the present invention is to provide a static eliminator capable of replacing a discharge needle and improving maintainability of the eliminator.

A static eliminator according to the present invention, which ionizes air blown onto an electrified object to be processed and eliminating static electricity from the object, comprises: an air guiding member supplying the ionized air by a fan and provided with a boss portion at its center portion; an outer electrode provided to said air guiding member; and an electric discharge module including a holder detachably mounted on said boss portion and discharge electrodes protruding toward said air guiding member in a outer-radial direction and attached to said holder.

In the static eliminator according to the present invention, said air guiding member is an air-guiding duct having a tubular portion, in which said boss portion is disposed at its center portion and said outer electrode is annular, and forming an air guiding path between said boss portion and said tubular portion.

In the static eliminator according to the present invention, the air-guiding duct is provided so as to be adjacent to an air blower provided with said fan.

In the static eliminator according to the present invention, said holder has a cylindrical portion fitted in said boss portion and a radial wall portion integrally formed with said cylindrical portion and opposing an end face of said boss portion, and an engagement groove engaged with an engagement protrusion protruding from an outer circumferential face of said boss portion in a outer-radial direction is formed in said cylindrical portion.

In the static eliminator according to the present invention, a high-voltage applying terminal being elastically deformable in a detaching/attaching direction of said electric discharge module and contacting with a base portion of said discharge electrode is provided to an end face of said boss portion.

In the static eliminator according to the present invention, a knob to be operated in detaching/attaching said electric discharge module is provided to said radial wall portion.

An electric discharge module according to the present invention, which is detachably mounted on a boss portion of an air guiding member and ionizes air blown onto an electrified object to be processed, the air guiding member having a tubular portion provided with an annular outer electrode and the boss portion disposed at a center of said tubular portion and forming an air guiding path for guiding the ionized air by an air-blowing fan, comprises: a holder having a cylindrical portion fitted in said boss portion and a radial wall portion integrally formed with said cylindrical portion and opposing an end face of said boss portion, the holder being detachably mounted on said boss portion; and discharge electrodes protruding toward said tubular portion in an outer-radial direction and attached to said holder, wherein an engagement groove is formed in said cylindrical portion and an engagement protrusion engaged with said engagement groove protrudes from an outer circumferential face of said boss portion in the outer-radial direction.

In the electric discharge module according to the present invention, said discharge electrodes are provided with large-diameter inward ends contacting with a high-voltage applying terminal provided to the end face of said boss portion so as to be elastically deformable in a detaching/attaching direction.

In the electric discharge module according to the present invention, a knob to be operated in being detached/attached is provided to said radial wall portion.

According to the present invention, the electric discharge module detachably mounted to the boss portion disposed at a center portion of the air guiding member having the outer electrode has the holder detachable/attachable from/to the boss portion and the discharge electrodes attached to the holder, so that in maintenance of the discharge electrodes, the electric discharge module can be easily detached from the boss portion. Furthermore, even when the electric discharge module is replaced, the module can be easily detached. In being detached, the electric discharge module fitted in the boss portion must be detached in a direction of blowing the ionized air. Therefore, even if various members are set around the static eliminator, the detaching operation can be easily performed. The electric discharge module includes only the discharge electrodes and the holder, and the electric discharge module is not provided with the high-voltage power-supply unit. Accordingly, even if the discharge electrodes deteriorate and the electric discharge module is to be replaced by a new one, an increase in maintenance costs of the eliminator can be prevented.

DESCRIPTION OF THE PREFERRED INVENTION

Figure 1:
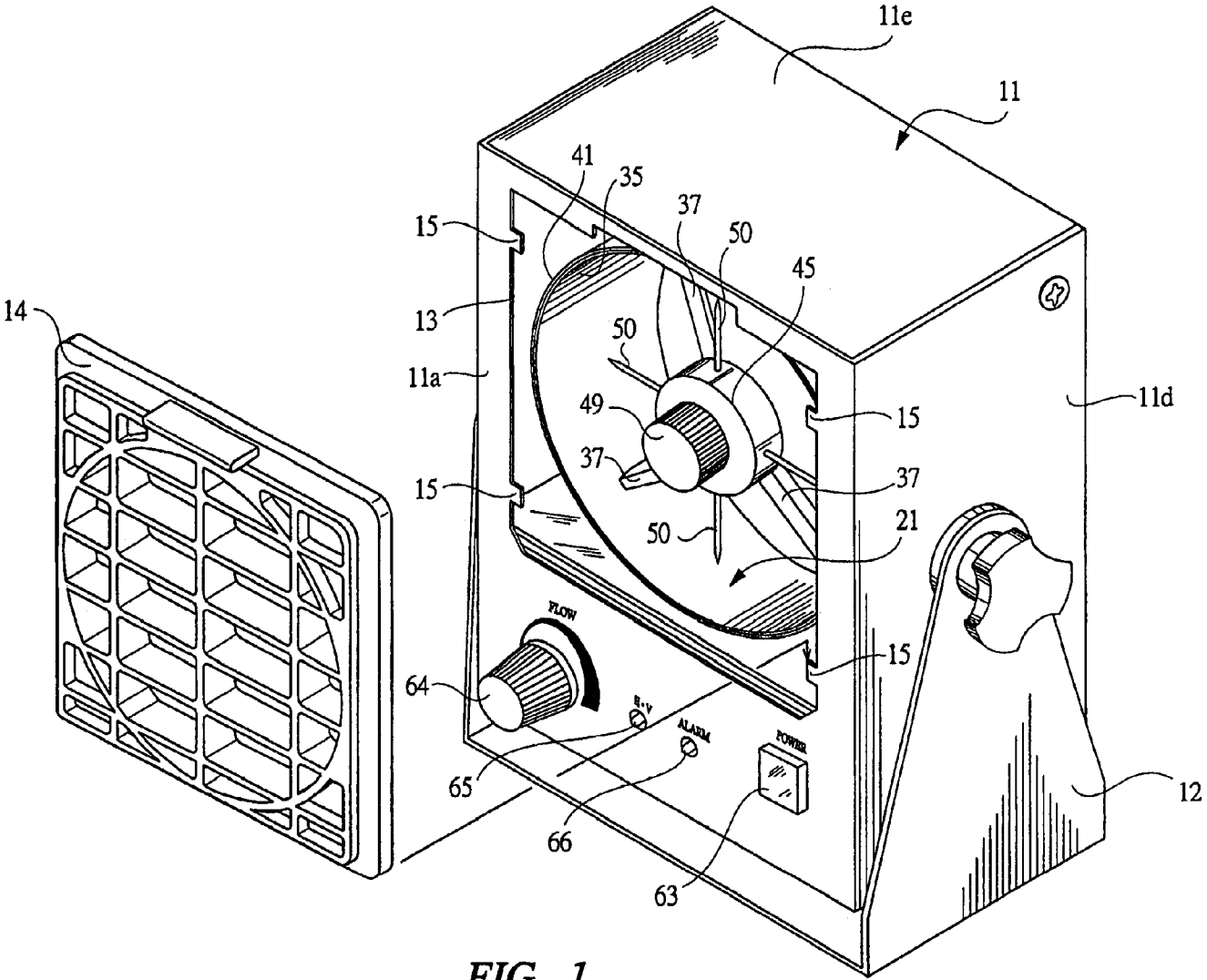
FIG. 1 is a perspective view showing a front side of a static eliminator according to one embodiment of the present invention.
Figure 3:
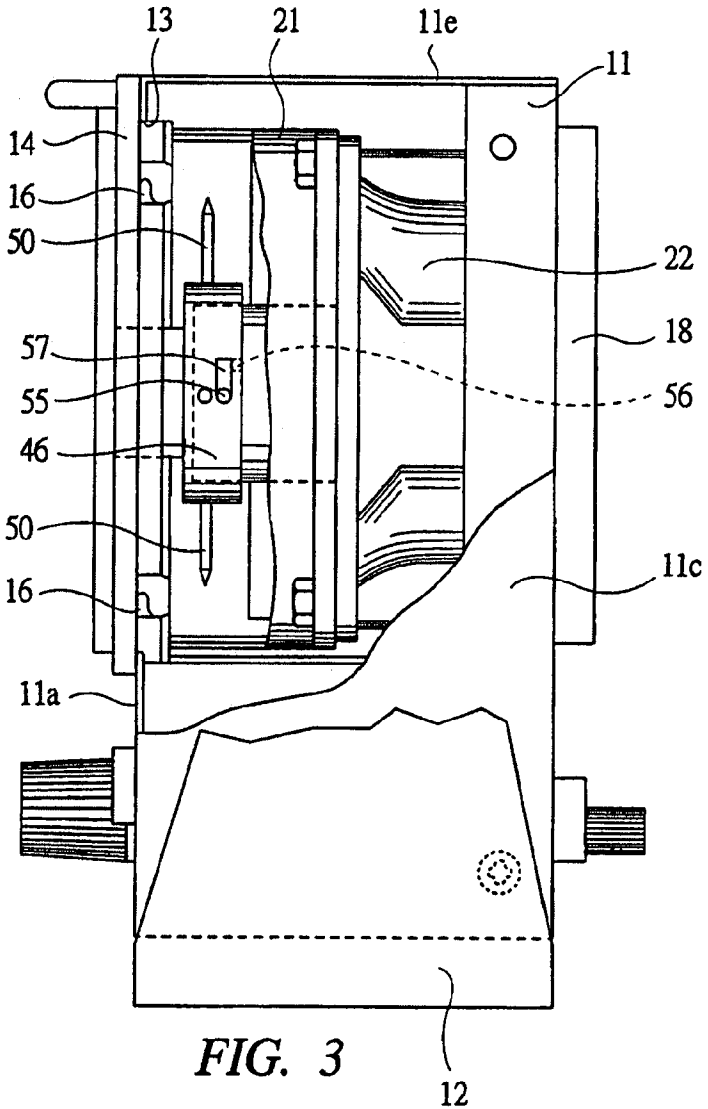
FIG. 3 is a partially-sectioned side view of the static eliminator shown in FIG. 1.
Figure 2:
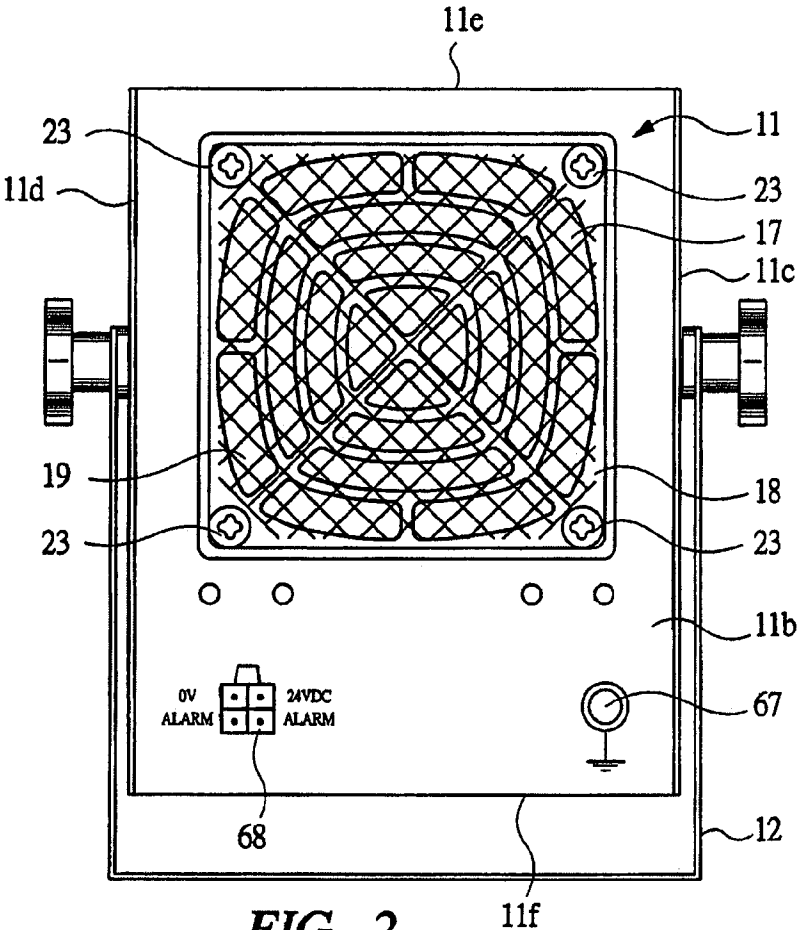
FIG. 2 is a rear view of the static eliminator shown in FIG. 1.

Hereinafter, embodiments according to the present invention will be detailed based on the drawings. FIG. 1 is a perspective view showing a front side of a static eliminator according to one embodiment of the present invention; FIG. 2 is a rear view of the static eliminator shown in FIG. 1; and FIG. 3 is a partially-sectioned side view of the static eliminator shown in FIG. 1.

A static eliminator includes a case body 11 formed into an approximately rectangular parallelepiped as a whole. The case body 11 has a front wall 11*a*, a back wall 11*b*, left and right sidewalls 11*c* and 11*d*, a top wall 11*e*, and a bottom wall 11*f*. The case body 11 is configured by combining a member integrally formed with the front wall 11*a* and the left and right sidewalls 11*c* and 11*d* and a member integrally formed with the back wall 11*b*, the top wall 11*e*, and the bottom wall 11*f*. A stand 12 is attached to the case body 11, so that the static eliminator is installed by the stand 12 at positions for use.

An opening portion 13 for blowing air is formed in the front wall 11*a*. A detachable louver 14 in which many air outlets are formed is detachably mounted on the opening portion 13. The front wall 11*a* is provided with engagement protrusions 15 protruding toward the opening portion 13. As shown in FIG. 3, engagement grooves 16 engaged with the engagement protrusions 15 are formed in the detachable louver 14, so that by moving the detachable louver vertically in a state in which a back face of the detachable louver 14 abuts on the front wall 11*a*, the detachable louver 14 can be attached to or detached from the case body 11.

As shown in FIG. 2, an opening portion 17 for air intake is formed in the back wall 11*b* of the case body 11. A fixed louver 18 in which many air intakes are formed is fixed to the opening portion 17. A reticular filter 19 for straining foreign substances such as dust contained in the intake air is attached outside the fixed louver 18.

An air-guiding duct 21 and an air blower 22, which serve as an air guiding member, are provided in the case body 11. As shown in FIG. 3, the air-guiding duct 21 is disposed on a side of the front wall 11*a* of the case body 11 rather than the air blower 22, and the air-guiding duct 21 and the air blower 22, together with the fixed louver 18, are fixed to the back wall 11*b* of the case body 11 by screw members 23.

Figure 4A:
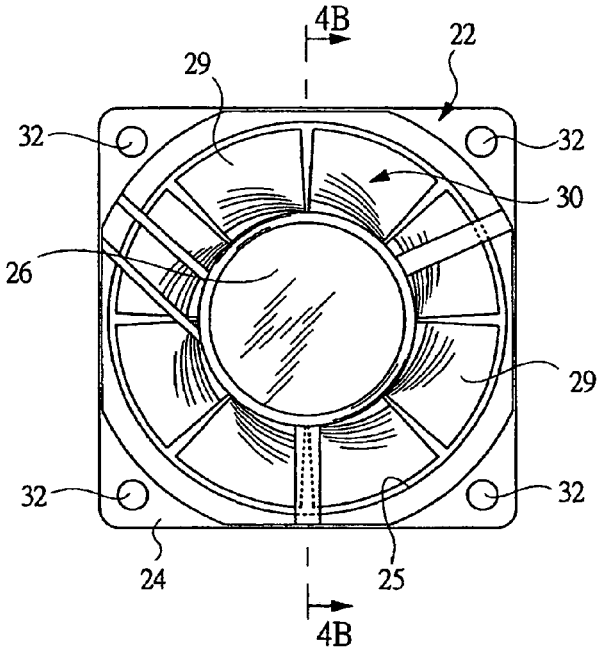
FIG. 4A is a front view showing an air blower.
Figure 4B:
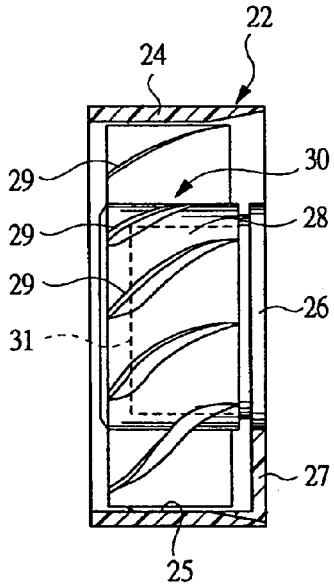
FIG. 4B is a sectional view taken along line 4B-4B in FIG. 4A.
Figure 4C:
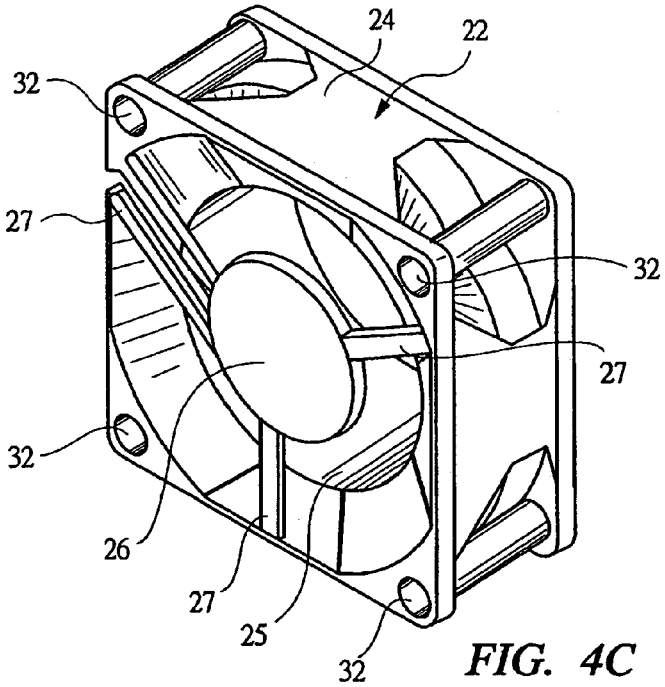
FIG. 4C is a perspective view showing a fan case of the air blower.
Figure 5A:
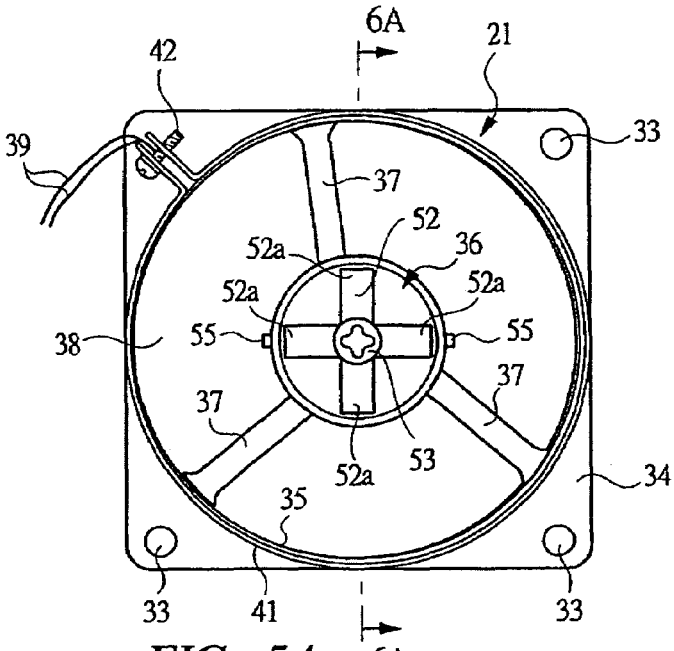
FIG. 5A is a front view of an air-guiding duct.
Figure 5B:
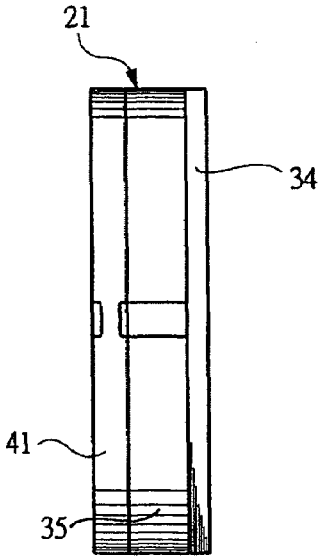
FIG. 5B is a side view of the air-guiding duct.

FIG. 4A is a front view showing the air blower 22; FIG. 4B is a sectional view taken along line 4B-4B in FIG. 4A; and FIG. 4C is a perspective view showing a fan case 24 of the air blower 22. FIG. 5A is a front view of the air-guiding duct 21 and FIG. 5B is a side view of the air-guiding duct 21.

A fan case 24 of the air blower 22 is made of a synthetic resin and, as shown in FIGS. 4A to 4C, is provided therein with a circular through hole 25. A circular supporting plate 26 is provided at a front end of the fan case 24 so as to be positioned at a center portion of the through hole 25. This supporting plate 26 is integrally formed with the fan case 24 by supporting bars 27. A fan 30, having a cylindrical fan boss 28 and a plurality of fan blades 29 integrally provided to an outer circumference of the fan boss 28, is rotatably mounted on the supporting plate 26, so that the fan 30 is revolved by a motor 31 incorporated inside the fan boss 28. Since the fan 30 is revolved by the motor 31, an airflow flowing from the opening portion 17 toward the air-guiding duct 21 is generated. Note that an attaching hole 32 through which the screw member 23 penetrates is formed at each of four corners of the fan case 24.

The air-guiding duct 21 is made of a synthetic resin which is an insulating material and, as shown in FIG*s*. 5A and 5B, has a tubular portion 35 at whose back end a flange portion 34 having an attaching hole 33 corresponding to the attaching hole 32 is integrally provided. A boss portion 36 is disposed at a center of the tubular portion 35. The boss portion 36 is integrally formed with the tubular portion 35 through three supporting bars 37, and an air guiding path 38 for guiding the air supplied from the fan 30 toward the opening portion 13 is formed between the boss portion 36 and the tubular portion 35. An annular outer electrode 41, which is formed by a metal strip material serving as a conductor, is wound outside the tubular portion 35. A screw member 42 for fastening the outer electrode 41 to the tubular portion 35 is attached to both ends of the outer electrode 41, and a lead wire 39 is attached to the screw member 42. Note that although the tubular portion 35 of the air-guiding duct 21 has a cylindrical shape, it may have a tetragonal or polygonal tubular shape and the outer electrode 41 may be embedded into the tubular portion 35.

In the illustrated static eliminator, the air-guiding duct 21, which is a member other than the fan case 24 of the air blower 22, is disposed so as to be adjacent to the air blower 22. However, a member corresponding to the tubular portion 35 may be provided integrally with the fan case 24 on a front side of the fan case 24 to form an air guiding member by using itself. In this case, the boss portion 36 to which an electric discharge module 45 is attached may be provided to the supporting plate 26 of the fan case 24. Also, by separating the air blower 22 and the air-guiding duct 21 from each other, air may be supplied to the air-guiding duct 21 serving as an air guiding member through a hose, pipe or the like.

Figure 6A:
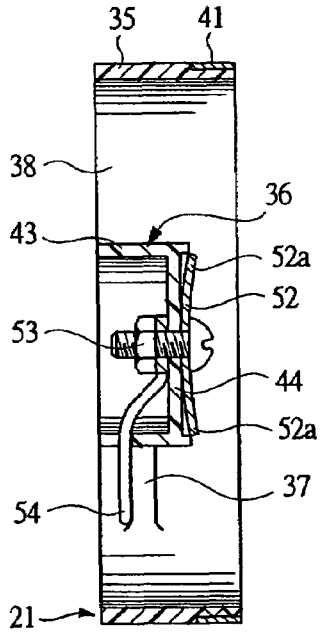
FIG. 6A is an enlarged sectional view taken along line 6A-6A in FIG. 5A.
Figure 6B:
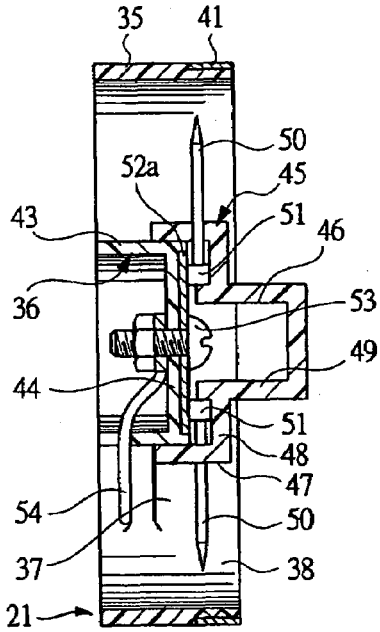
FIG. 6B is an enlarged sectional view showing a portion similar to that shown in FIG. 6A in a state in which an electric discharge module is mounted on a boss portion.

FIG. 6A is an enlarged sectional view taken along line 6A-6A in FIG. 5A. The boss portion 36 has a cylindrical portion 43 and a radial wall portion 44 integrally formed on a front end side of the cylindrical portion 43. The electric discharge module 45 can be detachably attached to the boss portion 36. FIG. 6B is an enlarged sectional view showing a portion similar to that shown in FIG. 6A in a state in which the electric discharge module 45 is attached to the boss portion 36.

The electric discharge module 45 has a holder 46 formed by a synthetic resin made of an insulating material. As shown in FIG. 6B, the holder 46 has a cylindrical portion 47 fitted outside the cylindrical portion 43 of the boss portion 36 and an end wall portion 48 integrally formed with a front end of the cylindrical portion 47. A cylindrical knob 49 is integrally provided to the end wall portion 48. When the electric discharge module 45 is mounted on the boss portion 36 of the air-guiding duct 21, the end wall portion 48 of the electric discharge module 45 opposes the radial wall portion 44 of the boss portion 36.

Figure 7C:
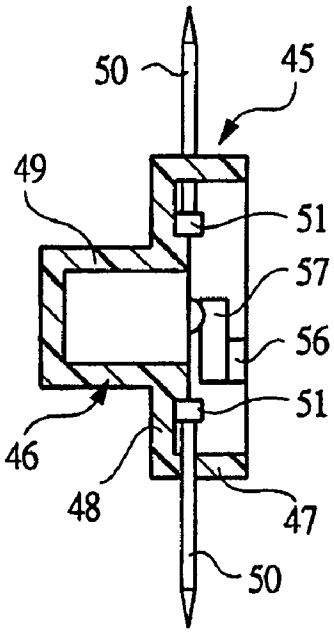
FIG. 7C is a sectional view taken along line 7C-7C in FIG. 7B.
Figure 7B:
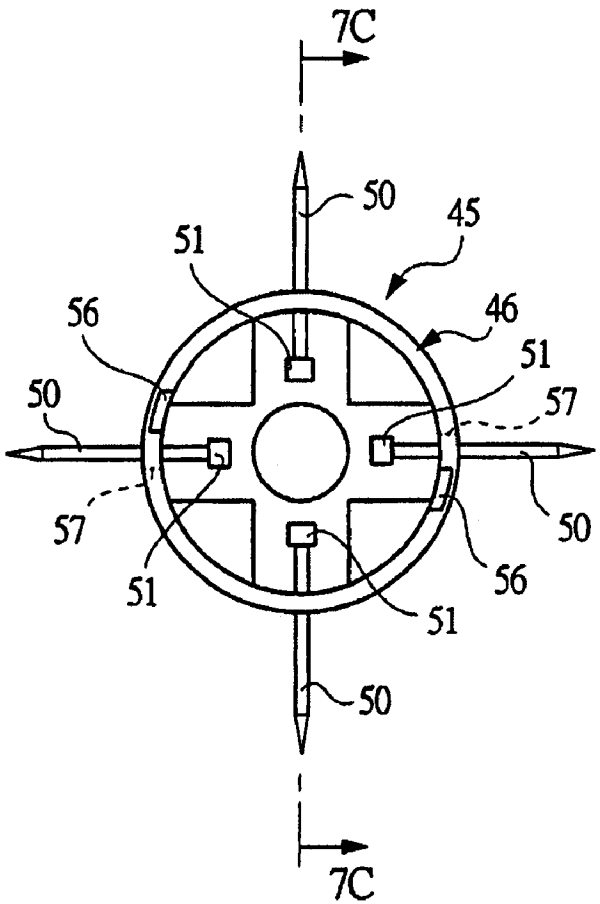
FIG. 7B is a rear view of the electric discharge module.
Figure 7A:
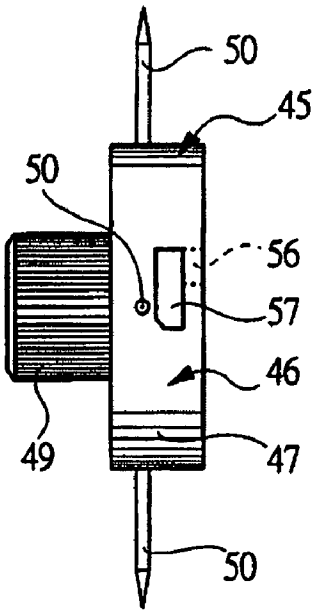
FIG. 7A is a sectional view of the electric discharge module.

FIG. 7A is a sectional view of the electric discharge module 45; FIG. 7B is a rear view of the electric discharge module 45; and FIG. 7C is a sectional view taken along line 7C-7C in FIG. 7B.

A plurality of discharge electrodes 50, which pass through the cylindrical portion 47 and protrude toward the tubular portion 35 of the air-guiding duct 21 in a outer-radial direction, are attached to the holder 46 of the electric discharge module 45. Each tip of the discharge electrodes 50 is sharp, and each base end thereof is provided with a large-diameter inward end portion 51. As shown in FIG. 7B, four discharge electrodes 50 are attached to the electric discharge module 45 at every 90 degrees in a circumferential direction of the cylindrical portion 47. As shown in FIG*s*. 5A and 5B and FIG*s*. 6A and 6B, an end face of the boss portion 36 is provided with a cross-shaped high-voltage applying terminal 52 integrally formed with four terminal pieces 52*a*. Therefore, when the electric discharge module 45 is mounted on the boss portion 36, each large-diameter inward end portion 51 of the discharge electrodes 50 contacts with the corresponding terminal pieces 52*a* of the high-voltage applying terminal 52, whereby the high-voltage applying terminal 52 is connected to a lead wire 54 via a screw member 53 for fixing the high-voltage applying terminal 52 to the boss portion 36

Each terminal piece 52*a* is elastically deformed in the detaching/attaching direction of the electric discharge module 45, that is, in a horizontal direction of FIG*s*. 6A and 6B. As shown in FIG. 6A, under the condition that the electric discharge module 45 is not mounted on the boss portion 36, a tip of each terminal piece 52a is elastically deformed in a direction of rising from a tip face of the boss portion 36. Thus, when the electric discharge module 45 is mounted on the boss portion 36, as shown in FIG. 6B, each terminal piece 52*a* of the high-voltage applying terminal 52 is elastically deformed to reliably contact with the large-diameter inward end portion 51 of the discharge electrode 50.

As shown in FIG. 5A, engagement protrusions 55 protruding in an outer-radial direction are provided integrally to the cylindrical portion 43 of the boss portion 36, and the two engagement protrusions 55 are provided to have a 180-degrees phase difference in a circumferential direction of the boss portion 36. As shown in FIG*s*. 7A to 7C, two engagement grooves 56 axially extending are formed on an inner circumferential face of the cylindrical portion 47 of the electric discharge module 45 so as to correspond to the engagement protrusions 55. An axial-outer end of each engagement groove 56 communicates with an end face of the cylindrical portion 47, and an axial-inner end of each engagement groove 56 communicates with an engagement hole (groove) 57 extending in an inner circumferential direction and formed in the cylindrical portion 47. Therefore, when the electric discharge module 45 is mounted on the boss portion 36, the electric discharge module 45 is pressed into the boss portion 36 by positioning the engagement grooves 56 opposite to the engagement protrusions 55 and fitting the cylindrical portion 47 of the electric discharge module 45 outside the cylindrical portion 43 of the boss portion 36. Thereafter, since the electric discharge module 45 is rotated, the engagement protrusions 55 are inserted in the engagement holes 57 and thereby the electric discharge module 45 is mounted on the boss portion 36. By such a mounting operation, the large-diameter inward end portion 51 of the base end of each discharge electrode 50 is pressed onto the terminal piece 52*a*, and a pushing force is applied to the large-diameter inward end portion 51 through an elastic force of the terminal piece 52*a*. When the mounting operation of the electric discharge module 45 is performed, an operator holds a knob 49 of the electric discharge module 45 by hand to perform a pressing operation and a rotating operation.

To detachably/attachably, i.e., removably mount the electric discharge module 45 on the boss portion 36, a structure of engaging the engagement protrusions 55 and the engagement groove 56 and the engagement hole 57 is used in the embodiment shown in Figures. However, instead of the structure, the electric discharge module 45 may be mounted on the boss portion 36 by a screw member.

Figure 8:
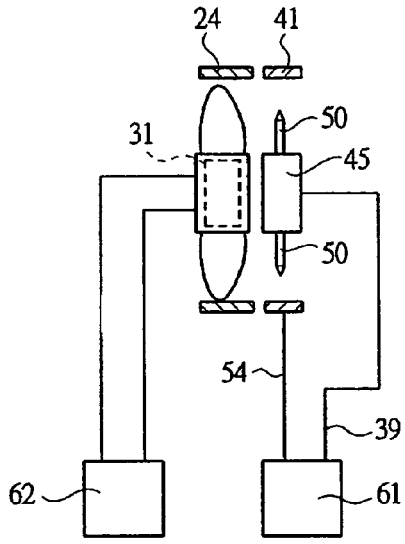
FIG. 8 is a schematic view showing a current carrying circuit of the static eliminator.

FIG. 8 is a schematic view showing a current carrying circuit of the above-described static eliminator. A high-voltage power-supply unit 61 for applying a high alternate-current voltage having a predetermined frequency is connected to each of the discharge electrodes 50 and the outer electrode 41 via lead wires 39 and 54, and a motor power-supply unit 62 is connected to a motor 31 via lead wires. The high-voltage power-supply unit 61 and the motor power-supply unit 62 are each incorporated in a lower portion of the case body 11 together with a control unit.

As shown in FIG. 1, a power-supply switch 63 for turning each of the power-supply units 61 and 62 on or off and a velocity adjustment dial 64 for adjusting the number of revolutions of the motor 31 and changing a flow rate of an airflow generated by the fan 30 are provided on the front wall 11*a* of the case body 11. Note that the reference numeral "65" denotes a display lamp turned on when the static eliminator is actuated, and "66" denotes a display lamp turned on when the static eliminator is in an abnormal state. As shown in FIG. 2, a ground terminal 67 and a power-supply terminal 68 are provided on the back wall 11*b*.

In order to use the above-mentioned static eliminator to blow the ionized air onto the object to be processed such as an electronic component and eliminate the static electricity charged with the object, the static eliminator is placed near the object so that the opening portion 13 is directed to the object. Under this state, when the power-supply switch 63 is turned on, the fan 30 is revolved by the motor 31. Therefore, external air flows from the opening portion 17 via the fixed louver 18 into the fan case 24, an airflow blown from the opening portion 13 via the detachable louver 14 toward the object is generated, and the air passing through the air guiding path 38 in the air-guiding duct 21 from an interior of the fan case 24 is ionized and is blown onto the object. The flow rate of the airflow is adjusted by operating the velocity adjustment dial 64. By turning on the power-supply switch 63, a high voltage having a predetermined frequency is supplied from the high-voltage power-supply unit 61 to the outer electrode 41 and each of the discharge electrodes 50, whereby the corona discharge is generated around the discharge electrodes 50. Due to this, the air flowing in the air guiding path 38 becomes ionized air containing positive ions and negative ions, and is blown onto the object. The electrified object is neutralized by the ionized air.

The motor 31 is incorporated in the fan boss 28 and the fan blades 29 are provided outside the fan boss 28, so that when the fan 30 is revolved to generate the airflow, no airflow is generated at the fan boss 28. However, since the electric discharge module 45 is disposed at a center portion of the air-guiding duct 21 so as correspond to the fan boss 28, a desired flow rate of ionized air can be supplied with miniaturization of the static eliminator. Each discharge electrode 50 protrudes from the holder 46 toward the outer electrode 41 in the outer-radial direction. The electric discharge module 45 can efficiently ionize the air flowing in the air guiding path 38 disposed between the air-guiding duct 21 and the electric discharge module 45 without interfering the airflow.

If the foreign substances or the like are educed out or adhere to the tip of the discharge electrodes 50, the detachable louver 14 is detached from the case body 11 as shown in FIG. 1, whereby the electric discharge module 45 is detached from the boss portion 36. At this time, the knob 49 is held by hand to rotate the electric discharge module 45 until each engagement groove 56 arrives at a position of the corresponding engagement protrusion 55. Thereafter, by pulling axially the electric discharge module 45, the electric discharge module 45 can be easily detached from the boss portion 36. In detaching it, the electric discharge module 45 includes only the holder 46 made of a resin and the discharge electrodes 50, so that the detaching operation can be easily performed. Similarly thereto, when any discharge electrode 50 deteriorates, an operation of replacing the electric discharge module can be also performed easily.

Figure 9A:
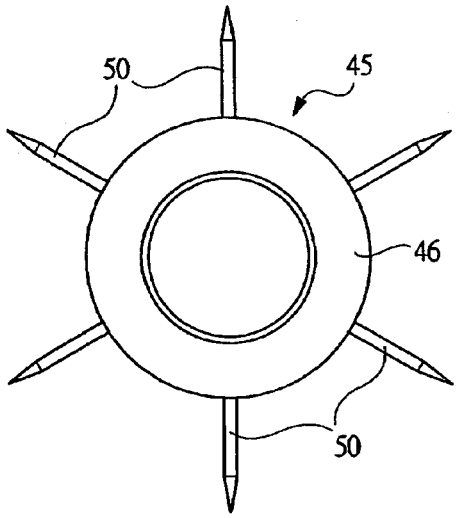
FIG. 9A is a front view showing a modification example of the electric discharge module.
Figure 9B:
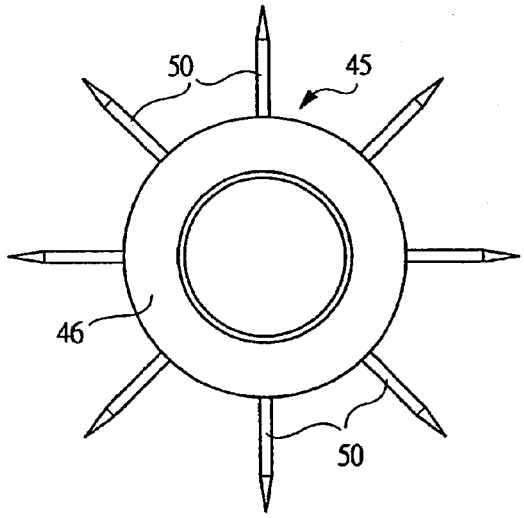
FIG. 9B is a front view showing another modification example of the electric discharge module.

FIGS. 9A and 9B are front views each showing a modification embodiment of the electric discharge module 45. In the electric discharge module 45 shown in FIG. 9A, six discharge electrodes 50 are provided to the holder 46. In the electric discharge module 45 shown in FIG. 9B, eight discharge electrodes 50 are provided to the holder 46. The number of discharge electrodes 50 attached to the electric discharge module 45 can be arbitrarily set depending on a condition such as the inner diameter of the air-guiding duct 21.

The present invention is not limited to the above-described embodiment and may be variously modified and altered within the scope of not departing from the gist thereof. For example, a direct current may be supplied to the outer electrode 41 and each discharge electrode 50. Also, the present invention can be applied also as an ozonizer for adding ozone to an airflow through a corona discharge.

What is claimed is:

1. A static eliminator ionizing air blown onto an electrified object to be processed and eliminating static electricity from the object, the eliminator comprising:

an air guiding member supplying the ionized air by a fan and provided with a boss portion at a center portion of the air guiding member;

an outer electrode provided on said air guiding member; and an electric discharge module including a holder having a cylindrical portion fitted outside said boss portion and a radial wall portion integrally formed with said cylindrical portion and opposing a radial end face of said boss portion, the holder being detachably mounted on said boss portion and a discharge electrode protruding from an inward base end portion toward the outer electrode on said air guiding member in an outer-radial direction and attached to said holder, said electric discharge module being detachable and attachable by rotating said electric discharge module relative to the boss portion by hand;

wherein the electric discharge module can be detached and attached by hand to facilitate replacement of said electric discharge module; and a high-voltage applying terminal being elastically deformable in a detaching/attaching direction of said electric discharge module and contacting the inward base end portion of said discharge electrode is provided on the radial end face of said boss portion.

2. The static eliminator according to claim 1, wherein said air guiding member is an air-guiding duct having a tubular portion, in which said boss portion is disposed at the center portion of the air guiding member and said outer electrode is annular, and forming an air guiding path between said boss portion and said tubular portion.

3. The static eliminator according to claim 2, wherein said air-guiding duct is provided so as to be adjacent to an air blower provided with said fan.

4. The static eliminator according to claim 1, wherein said holder has a cylindrical portion fitted in said boss portion and a radial wall portion integrally formed with said cylindrical portion and opposing an end face of said boss portion, and an engagement groove engaged with an engagement protrusion protruding from an outer circumferential face of said boss portion in an outer-radial direction is formed in said cylindrical portion.

5. The electric discharge module of claim 1, further comprising:

a case body to which said air guiding member and said electric discharge module are attached;

an opening portion for blowing air, which is formed in said case body; and a detachable louver in which air outlets are formed, said detachable louver detachably mounted on said opening portion.

6. The static eliminator according to claim 4, wherein a knob to be operated in detaching/attaching said electric discharge module is provided on said radial wall portion.

7. An electric discharge module detachably mounted on a boss portion of an air guiding member for ionizing air blown onto an electrified object to be processed, a radial end face of the boss portion having a high-voltage applying terminal being elastically deformable in the axial direction, the air guiding member having a tubular portion provided with an annular outer electrode and the boss portion disposed at a center of said tubular portion and forming an air guiding path for guiding the ionized air by an air-blowing fan, the module comprising:

a holder having a cylindrical portion fitted outside said boss portion and a radial wall portion integrally formed with said cylindrical portion and opposing the radial end face of said boss portion, the holder being detachably mounted on said boss portion; and a discharge electrode for ionizing air protruding toward said tubular portion in an outer-radial direction and attached to said holder, the discharge electrode having an inward base end portion that engages with the high-voltage applying terminal, wherein an engagement groove is formed in said cylindrical portion and an engagement protrusion engaged with said engagement groove protrudes from an outer circumferential face of said boss portion in the outer-radial direction, and said electric discharge module is detachable and attachable by rotating said electric discharge module relative to the boss portion by hand.

8. The electric discharge module according to claim 7, wherein said discharge electrode is provided with the large-diameter inward base end contacting with a high-voltage applying terminal provided on the end face of said boss portion so as to be elastically deformable in a detaching/attaching direction.

9. The electric discharge module according to claim 7, wherein a knob to be operated in being detached/attached is provided on said radial wall portion.

* * * * *